US011274414B2

(12) United States Patent
Sieber et al.

(10) Patent No.: US 11,274,414 B2
(45) Date of Patent: Mar. 15, 2022

(54) ADAPTER FOR A QUICK-CHANGE SYSTEM AND QUICK-CHANGE SYSTEM HAVING SUCH AN ADAPTER

(71) Applicant: OilQuick Deutschland KG, Steindorf (DE)

(72) Inventors: Johannes Sieber, Egling (DE); Michael Kollmann, Egling (DE)

(73) Assignee: OILQUICK DEUTSCHLAND KG, Steindorf (DE)

( * ) Notice: Subject to any disclaimer, the term of this patent is extended or adjusted under 35 U.S.C. 154(b) by 20 days.

(21) Appl. No.: 16/819,335

(22) Filed: Mar. 16, 2020

(65) Prior Publication Data

US 2020/0299921 A1 Sep. 24, 2020

(30) Foreign Application Priority Data

Mar. 18, 2019 (DE) ..... 10 2019 106 850.9

(51) Int. Cl.
*E02F 3/36* (2006.01)

(52) U.S. Cl.
CPC ..... *E02F 3/3622* (2013.01)

(58) Field of Classification Search
CPC ..... E02F 3/3622; E02F 3/3627; E02F 3/3654; E02F 3/3663; F16B 2200/30; F16D 1/0864; F16D 1/112; F16D 1/116; Y10T 403/69; Y10T 403/7009; Y10T 403/7073
USPC ..... 403/187, 198, 375, 387
See application file for complete search history.

(56) References Cited

U.S. PATENT DOCUMENTS 320,392 A * 6/1885 Peterson ..... 301/1
4,558,605 A * 12/1985 Tanner ..... F16D 1/0864 403/344
6,227,792 B1 5/2001 Baker et al.
6,474,898 B1 * 11/2002 Aota ..... F16D 1/0864 403/12
2004/0091308 A1 * 5/2004 Kinme ..... F16D 3/387 403/235

(Continued)

FOREIGN PATENT DOCUMENTS

DE 10 2004 014824 A1 10/2005
DE 10 2010 017179 A1 12/2011
DE 20 2017 103198 U1 6/2017

(Continued)

OTHER PUBLICATIONS

Machine Translation DE-202017107700-U1.*

(Continued)

*Primary Examiner* — Saul Rodriguez
*Assistant Examiner* — Brendan P Tighe
(74) *Attorney, Agent, or Firm* — Paul D. Bianco; Katharine Davis; Fleit Intellectual Property Law

(57) ABSTRACT

An adapter for a quick-change system for changing attachments on a construction machine, which contains two parallel pin-like coupling elements arranged between parallel side parts at a stipulated spacing from each other for connection of the adapter to a quick coupler and a coupling member support releasably fastened to one of the coupling elements to secure the coupling elements. In order to permit simplified fastening, the coupling member support is connected directly to the pin-like coupling element secured against torsion via a releasable form-fit connection.

13 Claims, 3 Drawing Sheets

(56) References Cited

U.S. PATENT DOCUMENTS

| | | | | |
|---|---|---|---|---|
| 2012/0128404 | A1* | 5/2012 | Sonerud | E02F 3/3654<br>403/31 |
| 2013/0309050 | A1* | 11/2013 | Takeda | B21D 43/00<br>414/222.07 |

FOREIGN PATENT DOCUMENTS

| | | | | |
|---|---|---|---|---|
| DE | 202017103198 | U1 * | 6/2017 | E02F 3/3663 |
| DE | 202017107700 | U1 * | 1/2018 | E02F 3/3654 |
| DE | 20 2018 100423 | U1 | 2/2018 | |
| WO | 2011/019312 | A1 | 2/2011 | |
| WO | 2016107703 | A1 | 7/2016 | |
| WO | 2018/074937 | A1 | 4/2018 | |

OTHER PUBLICATIONS

Machine Translation DE-202017103198-U1.*
Result of examination report for German Patent Application No. 10 2019 106 850.9 filed Mar. 18, 2019.
European Search Report dated Aug. 21, 2020 for Application No. EP 20 15 6522.

* cited by examiner

ADAPTER FOR A QUICK-CHANGE SYSTEM AND QUICK-CHANGE SYSTEM HAVING SUCH AN ADAPTER

FIELD OF THE DISCLOSURE

The disclosure concerns an adapter for a quick-change system. The disclosure also concerns a quick-change system having such an adapter.

BACKGROUND

Such quick-change systems are used for simple and convenient changing of different attachments on construction machines. For example, tilting buckets, grippers, claws, compactors, magnets, hydraulic hammers or other attachments can be connected to or disconnected from a boom of an excavator in a few seconds having a high level of safety from a driver's cab. They generally contain an adapter on the attachment side and a quick coupler arranged on the construction machine, which has first claw-like receptacles on one side to hold a first coupling element arranged on the adapter and second receptacles on the other side having at least one locking element movable between a release position and a locking position for releasable holding of a second coupling element arranged on the adapter.

An adapter for such a quick-change system is known from DE 20 2017 103 198 U1. This has a means for connection of the adapter to a quick coupler. A coupling element support to hold coupling elements on the adapter side for coupling having coupling elements on the quick-coupler side is fastened to one of the two pin-like coupling elements. For this purpose, connection pieces provided having receptacle openings for screws are welded onto one of the two pin-like coupling elements. A mount of the coupling element support provided having openings for the coupling elements can be screwed to these connection pieces by means of holding pieces welded to the mount. Fastening of the connection pieces to the pin-like coupling element and fastening of the holding pieces to the mount occurs via welds, which entails significant fabrication expense.

SUMMARY

One aspect of the disclosure relates to an adapter and a quick-change system having such an adapter that permits simplified fastening of the coupling member support.

Expedient embodiments and advantageous refinements are also disclosed.

The coupling member support in the adapter according to the disclosure is connected directly to the pin-like coupling element, secured against torsion by a releasable form-fit connection, and can be fastened releasably to the coupling element by means of screws or other fastening elements. A connection between the coupling element and the coupling member support, which is secure against torsion and which is simply releasable when necessary, can thereby be created even having out connection elements that are difficult to fasten to the coupling element. If any damage occurs to the coupling member support, it can therefore simply be replaced having out demanding alignment work. A friction-fit between the coupling member support and the coupling element can thus be achieved by means of screws, whereas the form-fit connection assures precise alignment and holding secure against torsion. Even during any changes or adjustment to the coupling member support, it can be simply disassembled and replaced having a correspondingly modified coupling element support.

The form-fit connection between the coupling member support and the coupling element can be formed in a variant that is particularly advantageous for manufacture by a form-fitting contour incorporated in the coupling element and a corresponding mating contour on the coupling member support.

The form-fitting contour on the coupling element can advantageously be formed by several groove-like recesses having different contact surfaces. The groove-like recesses can be incorporated in the outside of the coupling element having differently sloped contact surfaces.

The mating contour on the coupling member support that matches the form-fitting contour on the coupling element can be expediently arranged on laterally projecting fork-like holding pieces on the coupling member support. The holding pieces can be arranged on a strip-like mount provided having receptacles for coupling elements. The holding pieces can preferably be made in one piece having the strip-like mount. The mating contour can advantageously be formed by differently sloped mating surface on the inside of a fork-like recess.

For secure and true-to-position holding of the coupling element provided having the coupling member support on the side parts, the coupling element can be expediently fastened to the side parts, secured against torsion. For this purpose, connection between the coupling element and the side parts can occur, for example, by means of a form-fit connection having a special contour on the coupling element and a matching mating contour on at least one side part.

In another expedient embodiment, the coupling member support can be force-fit on the pin-like coupling element by screws. The screws, for example, can engage in threaded holes on the coupling member support through transverse holes in the pin-like coupling element.

The disclosure also concerns a quick-change system having an adapter just described and a quick coupler connectable to the adapter for simple changing of an attachment on vehicles.

BRIEF DESCRIPTION OF THE DRAWINGS

Further details and advantages of the disclosure are apparent from the following description of a preferred embodiment example having reference to the drawing. In the drawing.

DETAILED DESCRIPTION

Figure 1:
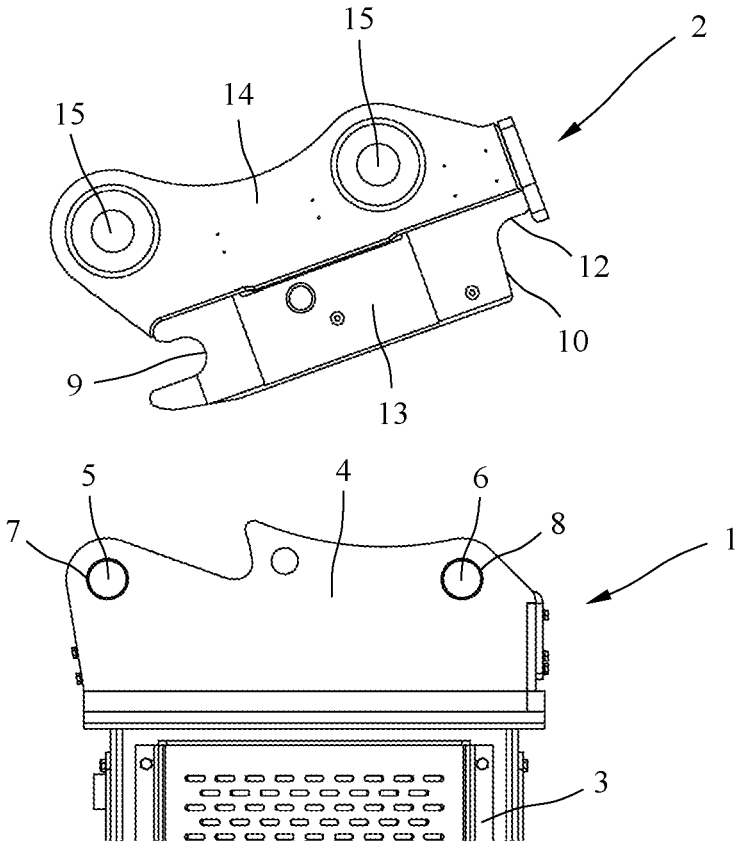
FIG. 1 shows a quick-change system having an adapter and a quick coupler in a separated position.
Figure 2:
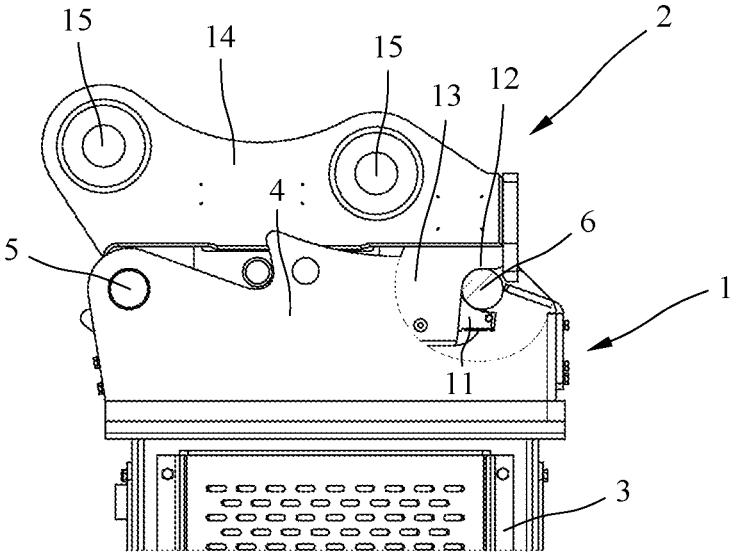
FIG. 2 shows the quick-change system of FIG. 1 in a coupled position.

A quick-change system consisting of an adapter 1 and a corresponding quick coupler 2 is shown in FIGS. 1 and 2 for simple changing of an only partially depicted attachment 3 to vehicles, especially construction machines, in a still separated position (FIG. 1) and in a coupled position (FIG. 2). Tilting buckets, grippers, jaws, magnets, compactors, hydraulic hammers or other mechanical or hydraulic attachments can be connected to and disconnected from a boom or other attachment of a construction vehicle simply and conveniently having such a quick-change system from a driver's cab.

The adapter 1 arranged on the attachment 3 contains two parallel side parts 4 spaced apart from each other, between which a first pin-like coupling element 5 and a second pin-like coupling element 6 arranged at a stipulated spacing from it are held for releasable connection to quick coupler 2. The two parallel pin-like coupling elements 5 and 6 are inserted into corresponding openings 7 and 8 in the two side parts 4 of adapter 1 and fixed there.

The quick coupler 2, mountable, for example, on a boom of an excavator contains, on one side, forward open, fork-like or jaw-like first receptacles 9 to receive and hold the first pin-like coupling element 5 and, on the other side, downwardly open second receptacles 10 having a movable locking element 11, shown in FIG. 2, to receive and hold second pin-like coupling element 6. The downwardly open receptacles 10 have a curved contact surface 12 for support of the second pin-like coupling element 6.

In the depicted embodiment, the quick coupler 2 contains a support 13 which includes two fork-like or jaw-like receptacles 9 on one side for the first coupling element 5 and two receptacles 10 on the other side for the second coupling element 6. Receiving openings 15 for fastening pins (not shown) for fastening of the quick coupler 2 to a boom of an excavator or connection part of another construction vehicle are also provided on two parallel side parts 14 arranged on the top of support 13.

The locking elements 11, designed in the depicted embodiment as locking pins, are arranged in two parallel guides of the quick coupler 2, designed here as guide holes in support 13; the locking elements are hydraulically displaceable between a retracted release position, shown in FIG. 1, and an extended locking position, shown in FIG. 2. In the extended locking position, the downwardly open second receptacles 10 are closed on the bottom by the pin-like locking element 11, so that the second pin-like coupling element 6 is engaged by the locking element 11 and the adapter 1 can be secured on the quick coupler 2.

In order to connect adapter 1 to the quick coupler 2, the quick coupler 2 generally arranged on a boom of an excavator is initially moved so that the first pin-like coupling element 5 on adapter 1 is introduced to the jaw-like receptacles 9 on one side of the quick coupler 2. The quick coupler 2 having the still drawn locking elements 11 is then pivoted around the first pin-like coupling element 5 so that the second pin-like coupling element 6 on adapter 1 comes into contact having the support surfaces 12 of the downwardly open receptacles 10 on the other side of the quick coupler 2. The pin-like locking elements 11, arranged to be displaceable in the support 13 of the quick coupler 2, can then be extended hydraulically according to FIG. 2, so that the second pin-like coupling element 6 on adapter 1 is engaged by the two pin-like locking elements 11 on the quick coupler 2 and the adapter 1 is therefore secured on the quick coupler 2.

Figure 3:
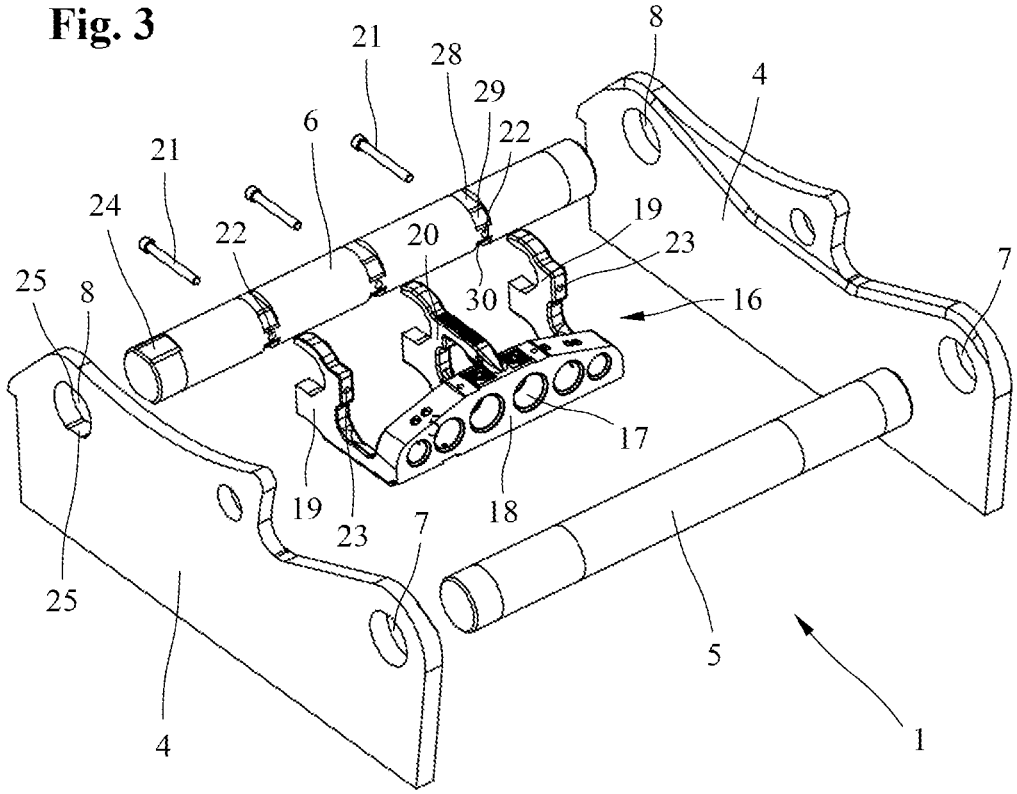
FIG. 3 shows an adapter having a coupling member support in an exploded view.
Figure 4:
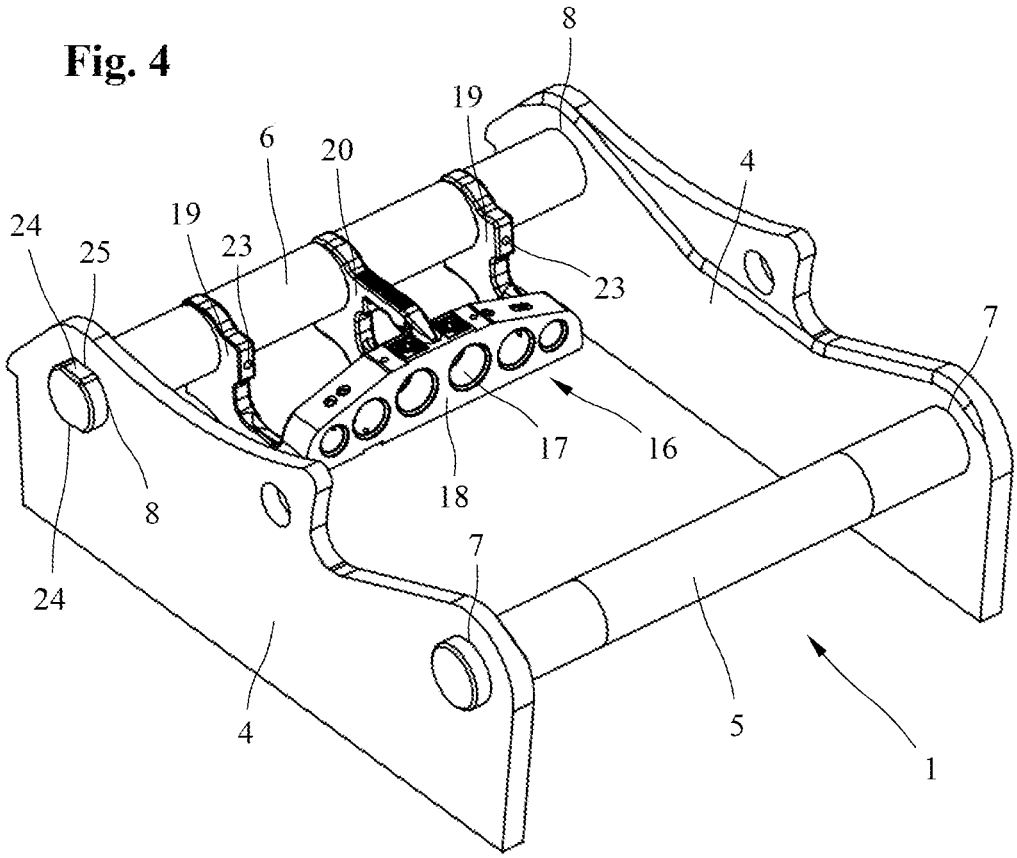
FIG. 4 shows the adapter of FIG. 3 in the mounted state.

As follows from FIGS. 3 and 4, a coupling member support 16 is releasably attached on the second pin-like coupling element 6 of adapter 1 to hold the coupling members on the adaptor-side for connecting with coupling members on the quick coupler-side. Power connections provided for power supply to attachment 3 on adapter 1 can be automatically connected by means of the coupling members on the adapter side (not shown) arranged on the coupling member support 16 to corresponding power supply lines on the quick coupler 2 during connection of the adapter 1 to the quick coupler 2. The attachment 3 can thereby be supplied having hydraulic fluid, electrical power, or another energy source.

The coupling member support 16 has a strip-like mount 18 arranged parallel to coupling element 6 provided having hole-like receptacle 17 for coupling elements having holding pieces 19 and 20 arranged on it for releasable connection to the pin-like coupling element 6. In the depicted embodiment, two fork-like outer holding pieces 19 and a fork-like inner holding piece 20 are arranged on the strip-like mount 18. The coupling member support 16 is force-fit by screws 21 onto coupling element 6 by means of the fork-like holding pieces 19 and 20 that engage above coupling element 6. The screws 21 engage through transverse holes 22 in the coupling element in threaded holes 23 of the holding pieces 19 and 20. For holding the pin-like coupling element 6 secure against torsion relative to the side parts 4, the coupling element 6 has opposite flat areas 24 on at least one end for engagement having corresponding mating surfaces 25 on the corresponding opening 8 in the side part 4.

Figure 5:
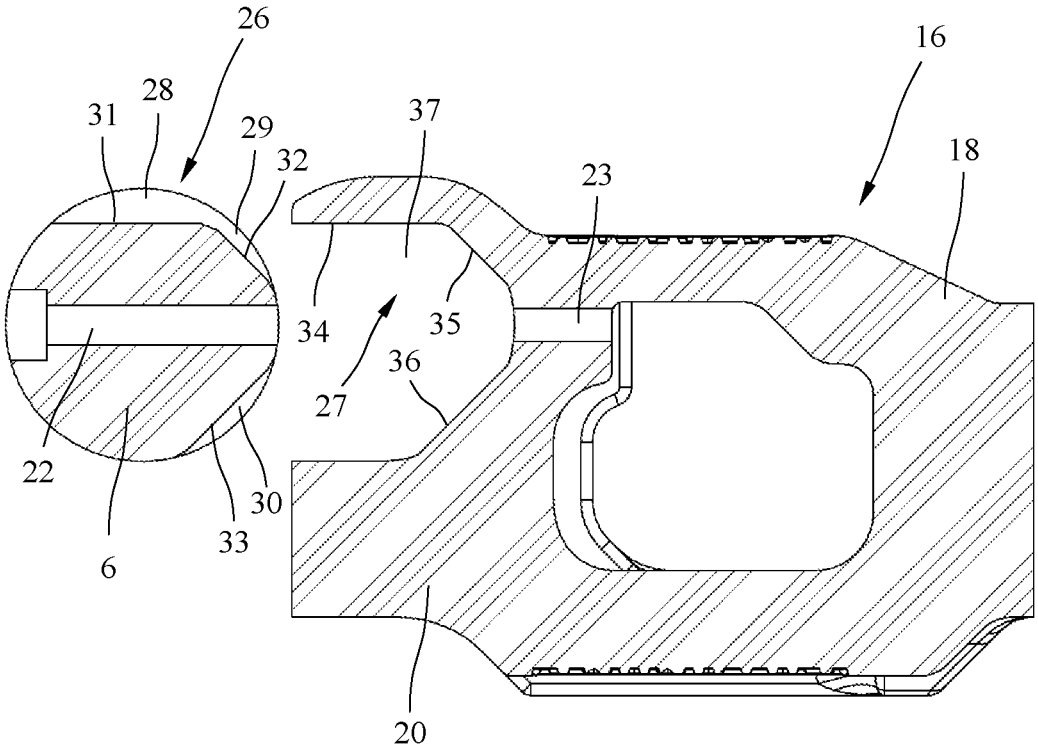
FIG. 5 shows a cross section through the adapter having a coupling element and the coupling member support in a still unmounted state and FIG. 6 shows a cross section through the adapter having a coupling element and a coupling member support in a mounted state.
Figure 6:
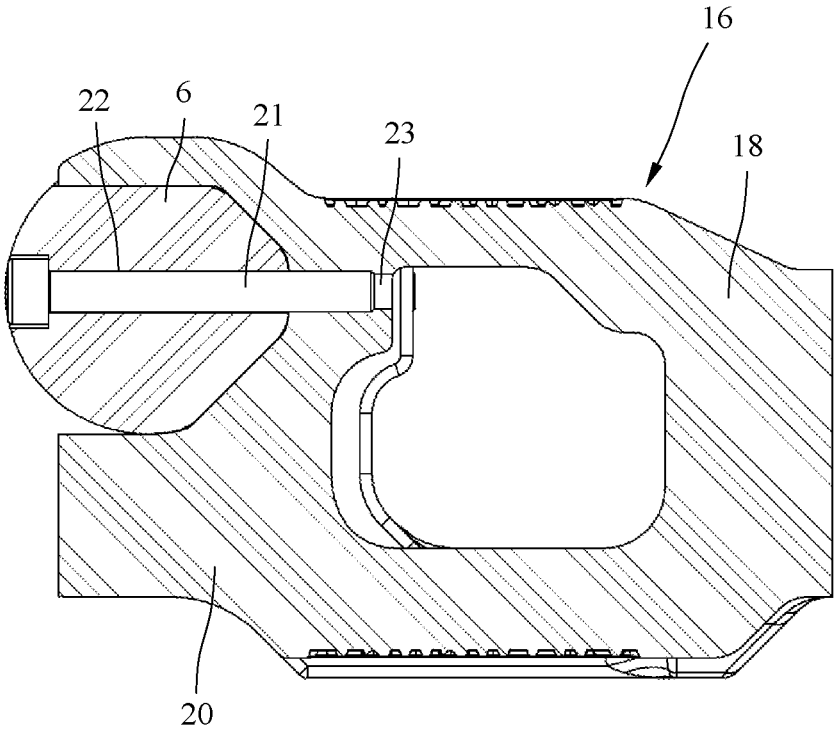

It is apparent from FIGS. 5 and 6 that the outside of the pin-like coupling 6 contains an incorporated form-fitting contour 26 for form-fit engagement having a corresponding mating contour 27 on the projecting fork-like holding pieces 19 and 20 of the coupling member support 16 opposite mount 18. In the depicted embodiment example, the form-fitting contour 26 on coupling element 6, designed as the outer contour having recesses, is formed by several groove-like recesses 28, 29 and 30, also apparent in FIG. 3, which are incorporated having different angles on the outside of the pin-like coupling element 6 and form differently sloped contact surfaces 31, 32 and 33 for support on corresponding mating surfaces 34, 35 and 36 of the coupling member support 16. The mating surfaces 34, 35 and 36 are provided on the inside of a fork-like recess 37 on the laterally projecting holding pieces 19 and 20 of the coupling member support 16.

LIST OF REFERENCE NUMBERS

1 Adapter
2 Quick coupler
3 Attachment
4 Side part
5 First coupling element
6 Second coupling element
7 Opening
8 Opening
9 First receptacle
10 Second receptacle
11 Locking element
12 Contact surface
13 Support
14 Side part
15 Receptacle opening
16 Coupling member support
17 Receptacle
18 Mount
19 Outer holding piece
20 Inner holding piece
21 Screw
22 Transverse hole
23 Threaded hole

24 Flat area
25 Mating surface
26 Form-fitting contour
27 Mating contour
28 Recess
29 Recess
30 Recess
31 Contact surface
32 Contact surface
33 Contact surface
34 Mating surface
35 Mating surface
36 Mating surface
37 Recess

The invention claimed is:

1. An adapter for a quick-change system configured for changing attachments on a construction machine, the adapter comprising:

two side parts arranged parallel to each other;

first and second elongated coupling elements arranged parallel to and at a predetermined distance from each other and between the two side parts, the first and second elongated coupling elements configured for connecting the adapter to a quick coupler; and a coupling member support for securing coupling members, the coupling member support is releasably connected directly to the second elongated coupling element via a releasable form-fit connection, the releasable form-fit connection securing the coupling member support against torsion.

2. The adapter according to claim 1, wherein at least the second elongated coupling element is fastened to the two side parts secured against torsion.

3. The adapter according to claim 2, wherein a first end portion of the second elongated coupling element is fastened to one of the two side parts via a form-fit connection and a second end portion of the second elongated coupling element is fastened to the other of the two side parts via a form-fit connection, thereby securing the second elongated coupling element against torsion.

4. The adapter according to claim 1, wherein the coupling member support is force-fit via screws to the second elongated coupling element.

5. The adapter according to claim 4, wherein the screws engage in threaded holes on the coupling member support through transverse holes on the second elongated coupling element.

6. The adapter according to claim 1, wherein the coupling member support comprises a mount portion, arranged as a strip parallel to the second elongated coupling element, and a plurality of holding portions laterally extending from a surface of the mount portion, each holding portion of the plurality of holding portions having a bifurcated end.

7. The adapter according to claim 6, wherein the mount portion and the plurality of holding portions are formed as one piece.

8. The adapter according to claim 6, wherein each holding portion of the plurality of holding portions is fastened to the second elongated coupling element via a form-fit connection made by engaging form-fitting contours of the second elongated coupling element with corresponding mating contours of the holding portion.

9. The adapter according to claim 8, wherein the form-fitting contours are formed by a plurality of recesses in an outer surface of the second elongated coupling element, each recess of the plurality of recesses having a contact surface.

10. The adapter according to claim 9, wherein each recess of the plurality of recesses is formed such that each contact surface has a different slope.

11. The adapter according to claim 8, wherein the corresponding mating contours of the coupling member support are formed in each holding portion of the plurality of holding portions laterally extending from the surface of the mount portion.

12. The adapter according to claim 11, wherein the corresponding mating contours of the coupling element support are formed by differently sloped mating surfaces on inner surfaces of the bifurcated end of each holding portion of the plurality of holding portions.

13. A quick-change system for changing attachments on a construction machine comprising the adapter according to claim 1 and a quick-coupler configured for connection with the adapter.

* * * * *